US005153566A

United States Patent [19]

Yun

[11] Patent Number: 5,153,566

[45] Date of Patent: Oct. 6, 1992

[54] MOTION SENSOR SWITCH AND ANNUNCIATOR DEVICE

[75] Inventor: Chu C. Yun, Kowloon, Hong Kong

[73] Assignee: Unitoys Company Limited, Kowloon, Hong Kong

[21] Appl. No.: 670,312

[22] Filed: Mar. 15, 1991

[51] Int. Cl.[5] ..... G08B 21/08

[52] U.S. Cl. ..... 340/689; 200/61.45 R; 200/61.52; 340/566; 340/669

[58] Field of Search ..... 340/689, 669, 566, 603, 340/429; 200/61.45 R, 61.52

[56] References Cited

U.S. PATENT DOCUMENTS 3,742,478 6/1973 Johnson ..... 340/689

3,752,945 8/1973 Acterberg ..... 200/61.52

*Primary Examiner*—Glen R. Swann, III

*Attorney, Agent, or Firm*—Ronald M. Goldman

[57] ABSTRACT

A motion sensor includes an array of interdigitated zig zag shaped conductors, a metal sphere for bridging adjacent conductors and a housing formed of an electrically insulative material in a one-piece molded assembly defining a chamber in which the sphere rolls upon the indigitated conductors. The chamber contains a cylindrical wall and an annular wall, the latter of which is of the geometery of a right conic section coaxial with the cylindrical wall. Movement of the ball bridges and unbridges adjacent conductors to cause electrical current surges. Electronic detector provides audible signal upon detection of such current surges. The cylindrical wall serves to rigidize the housing and the tapered inner wall renders the sensor more tolerant of positioning on an installed object.

17 Claims, 1 Drawing Sheet

MOTION SENSOR SWITCH AND ANNUNCIATOR DEVICE

FIELD OF THE INVENTION

This invention relates to motion sensors and alarms and, more particularly, to an improved motion sensor structure suitable for application in novelty items that require detection of motion, and/or detection of very slight vibration.

BACKGROUND

Heretofore certain battery operated toys or novelty items, as variously termed, have been marketed that, when shaken, produce a noise or other sound in response. The nature of such responsive sound provides obvious amusement to the user. As example, a toy simulated frog, when so disturbed, produces a croaking sound, simulating, to a degree, a live frog's response.

In those kind of novelty items the motion sensor is included as part of an electrical circuit that is supplied with electrical current from batteries that are self-contained within the item. The batteries serve also to supply current to the audio generating circuits that produce the sound or alarm. When activated, as by shaking the novelty item and thereafter replacing that item in a stable position, the audio sound generation is initiated and, continues for a predetermined interval following cessation of the shaking action through appropriate action of time delay circuits contained within the item. This provides for the appropriate amusement for the user and also conserves the battery's energy.

As one appreciates, novelty items of this type are manufactured in high volume and, to be viable in the retail marketplace from the standpoint of price point, must be currently being marketed the device contained an inertia type motion sensor of very inexpensive construction that obviously satisfies the referenced cost consideration. The motion sensor, however, quickly developed the propensity to "stick"; that is, the inertia switch remained closed and, consequently, the toy emitted sound continuously, resulting in prematurely draining the electrical batteries that powered the toy. Although capable of detecting vibration and/or movement the amusement device was thus not reliable.

It is recognized that a motion sensor of more exotic construction may well serve to cure the reliability problem in the aforesaid device. However, known motion sensors of that type appear to be of a construction that is too expensive for use in novelty item application.

A motion sensor design is presented in U.S. Pat. No. 4,196,429, granted Apr. 1, 1980 to Davis. In that design a pair of cylinders of electrical insulator material are coaxially concentrically arranged to form an annular cylindrical cavity. The inner wall of the outer cylinder contains a series of electrical conductors arranged in two portions. Each portion is formed of spaced extending conductive fingers, including fingers of a zig-zag shape, and extend along the wall axial of the cylinder. The fingers of the two portions are interdigitally arranged and spaced to provide direct electrical isolation there between. An electrically conductive metal ball is loosely disposed within the annular cavity and bridges adjacent fingers, thereby closing an electrical circuit between the two portions of conductors. Suitably, any rolling movement of the ball along the axis of the structure or around the periphery results in the ball causing interruption in the electrical circuit by alternately bridging and un-bridging contacts between adjacent interdigitated conductive fingers. When an article carrying the sensor is moved or shaken the mechanical inertia of the confined metal ball causes the ball to effectively move or roll in the chamber relative to the chamber's walls, thereby creating numerous interruptions and initiations of electrical current flow. Accompanying electronic circuits detect the transition of the current, the current surge, and initiate action of an alarm.

Although the practicality and effectiveness of the motion detector design presented by Davis in novelty item application is not known, the principle of a metal ball to detect motion, evidenced in the Davis patent, appears well founded. The Davis structure is essentially three dimensional in nature; that is, it requires the formation of a pattern of electrical conductors on a curved surface, the cylinder wall. That curved arrangement may be accomplished in either of two ways: forming a circuit pattern on a cylindrical shaped circuit board, which appears difficult and, consequently, expensive, or, alternatively, forming the circuit arrangement on a flat, relatively flexible circuit board which, thereafter, may be formed or assembled into the cylindrical shape desired in the Davis structure. This latter assembly would also appear to add expense and increased difficulty to manufacture as detracts from novelty item application.

An object of the present invention is to provide a reliable low cost motion sensor construction of the simplest possible structure that uses the principal of the inertia of a metal ball to detect motion. It is a further object of the invention to provide a ball type motion sensor that does not require formation of electrical conductors onto curved surfaces. It is a still additional object of the invention to provide a low cost easily assembled motion detector for use in toy applications that has sufficient sensitivity to detect such slight vibrations as would be caused by stroking or petting the toy by hand. An ancillary object to the invention is to provide a motion sensor that may easily be integrated into, or be formed as part of, a printed circuit board containing the audio generators and other ancillary electronic circuits and which is suitable for robotic or machine assembly.

SUMMARY OF THE INVENTION

The motion sensor of the present invention is characterized by a flat planar circuit board on which is included first and second conductor portions, each of which contains essentially linearly extending fingers, spaced apart from one another, with the extending fingers of one portion being arranged interdigitally and in opposite direction to the fingers of the second portion, but without physical contact therebetween, so as to maintain direct electrical isolation between the two portions and provide a path containing spaced elongate electrical contacts of alternating electrical polarity, forming a grating like structure. A housing member formed of an electrically insulative material in a one-piece molded assembly, suitably plastic, defines a circular chamber open along one side. That chamber is characterized by a depending cylindrical post and an inner wall, surrounding the post, in the form of a right conic section coaxial with the post and the chamber is closed at one end by a planar washer shaped top wall leaving an open side. The housing member is attached to the circuit board with the end of the post abutting the board and, consequently, a portion of the conductors to close the chamber, with the housing member essentially covering the first and second set of conductors, the latter which are oriented transverse the formed chamber. A metal sphere is confined within the chamber.

Suitably, the diameter of the sphere is great enough to bridge adjacent interdigital conductive fingers on the circuit board, and small enough in diameter so as to be able to roll either along the peripheral or radially within the formed chamber. Suitably, electrical leads connect to each of the circuit board portions, which are connected to an appropriate electrical circuit that detects the electrical "make" and/or "break" contact action of the steel sphere moving, within the confined chamber, responsive to motion of the sensor.

With few easily manufactured parts of relatively simple shape a low cost motion sensor is thus achieved It is found in practice that the sensor is tolerant of less than precise orientation when mounted within the toy structure. Should the sensor be mounted, either vertically or horizontally or in any intermediate angle, an acceptable functional result is nonetheless achieved. That advantage is particularly useful in applications in which the sensor is placed somewhat loosely positioned within the stuffing of a stuffed toy. It is also found that the sensitivity is such that the novelty device containing the motion sensor of the invention generates the audible sound in response to the user simply "petting" the toy.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustrations thereof presented in the accompanying drawings.

IN THE DRAWINGS

DETAILED DESCRIPTION OF A PREFERRED EMBODIMENT

Figure 1:
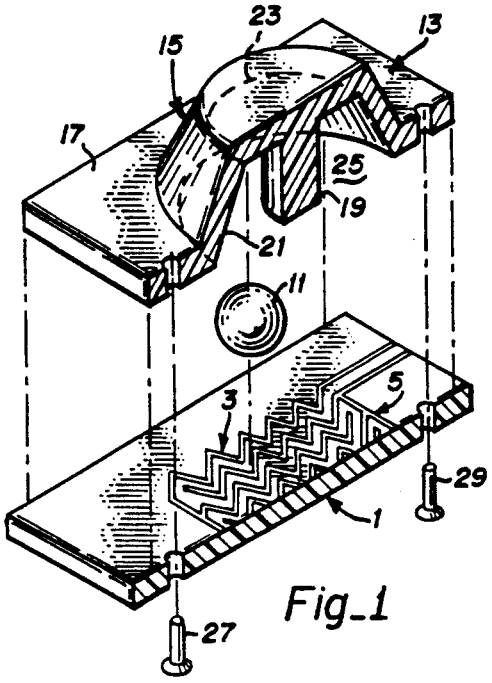
FIG. 1 illustrates the mechanical portion of the motion sensor in a exploded partial section view.

Reference is made to FIG. 1 in which a preferred embodiment of the motion sensor is presented in partial exploded view. The motion sensor includes a printed circuit board, 1, of conventional insulator structure. A first conductor portion or set, 3, suitably copper, is mounted on, or, more appropriately, formed upon, the top planar surface of the board and a second conductor portion or set, 5, also suitably of copper, is also mounted to, more appropriately, formed upon that board surface. Each set of conductors is shown to contain a set of linearly extending zig-zag shaped fingers spaced from one another and extending from a common conductor, that bridges the fingers. The fingers of set 3 extend in opposite directions and are oriented interdigitally with the corresponding fingers of set 5. As illustrated, the tips of the fingers of one set are physically spaced from the bridging conductor of the other set, and vice-versa, so as to electrically isolate the two sets from one another. The described conductors are formed atop circuit board 1 through conventional printed circuit board fabrication technique. The upper surface of the conductive fingers remains exposed, that is, is not covered by any insulating layer or coating as is frequently the practice to circuit board conductors. This allows direct electrical contact between the fingers and another sensor element, as later described.

The sensor contains a metal sphere or ball, 11. The ball is suitably formed of steel, a low cost conductive material, and then is plated with another more highly electrically conductive metal, such as gold or silver, as example, to provide a highly electrically conductive outer spherical surface. Those skilled in the art recognize that the balls may be formed of other materials as well with at least the outer surface being electrically conductive.

A housing member, 13, includes a raised portion, 15, that is dome-like in appearance. The dome-like portion is surrounded by a rectangular shaped flange section, 17. The housing defines an internal cavity, which is illustrated as 25. A cylindrical post, 19, depends from the top inner wall of the protruding dome. The post is of a height approximately equal to the distance to the bottom of housing member 17 and, preferably, contains a flat circular end surface, the end being essentially co-planar with the bottom surface of flange 17. An inner side wall, 21, of the dome is spaced from the post. Side wall 21 is the shape of a section of a regular right cone and forms a right conic section. On the inside top surface an annular, or washer shaped top end wall, illustrated by the dash lines, 23, closes the top end of the formed cavity, generally designated as 25 in the figure.

As viewed from the underside of the housing member, cavity 25 is open on the bottom side and the bottom opening is of washer shape in appearance. Housing 13 is formed in a single piece and comprises a one piece unitary assembly of electrically nonconductive material, suitably plastic, formed by conventional injection molding technique. The details of injection molding are well known to those skilled in the art and, accordingly, need not be further discussed.

To assemble the sensor, metal ball 11 is placed on the circuit board slightly off-center and housing member 13 is moved into position atop the board, allowing the ball to be received into the peripherally extending chamber to thereby confine the ball within the annular chamber, 25. The housing is moved or rotated to align its rivet holes with the corresponding rivet holes on the circuit board. Rivets 27 and 29 are then placed through openings in housing member 13 and are fastened in place to hold the sensor together.

Figure 2:
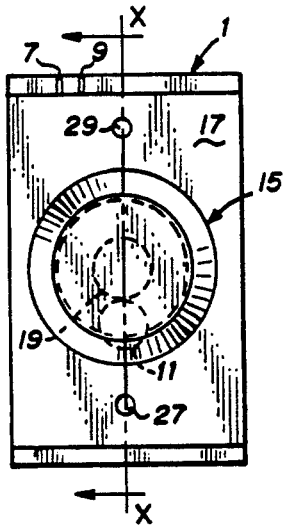
FIG. 2 illustrates the sensor portion of FIG. 1 in top view as fully assembled.

A fully assembled motion sensor is illustrated in top plan view in FIG. 2, to which reference is made. For convenience, the labeling of elements earlier discussed in connection with FIG. 1 is carried through in the illustrations of FIG. 2 and in the remaining figures with like identification numerals. As better illustrated in this view, the circuit board, 1, is of slightly greater length than the length of flange 17. The housing assembly serves as a protective cover to the electrical conductors, 3 and 5, not visible in this view, except for the extending terminal leads, 7 and 9, shown to the upper left in the figure. The electrical terminal leads allow connection of the motion sensor to the appropriate positive and negative or ground polarities of the associated electrical circuit, later discussed in greater detail.

As indicated in the dotted lines, ball 11 is free to travel in the confining chamber, peripherally, in a circle about center post 19. Moreover, because the diameter of the ball is less than the distance between the side of the post and the annular side wall of the housing, as measured from a height equal to the ball's radius from the bottom, the ball may travel radially to some limited extent between the post and the housing's inner side wall. Any combination of those two movements is also possible.

Figure 3:
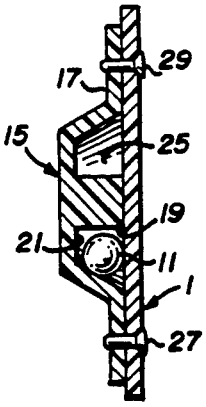
FIG. 3 illustrates the sensor portion in section view taken along the lines X—X in FIG. 2.

FIG. 3 illustrates the motion sensor in a section view taken along the lines X—X of FIG. 2. In this latter view the conductors, 3 and 5 in FIG. 1, are not separately illustrated, as they, typically, are so thin as not to be viewable in the figure to the scale of drawing given. Typically, for a circuit board of 0.063 inches in thickness the plated electrical conductors are between 0.0015 to 0.0020 inches in thickness. As illustrated, the bottom end of post 19 is essentially co-planar with the bottom surface of flange 17. As assembled, the flange and the end of post 19 are in abutment with the circuit board. The end of post 19, moreover, overlies a portion of electrical conductors 3 and 5, inasmuch as the conductors are oriented transverse to the now closed annular cavity 25, as was illustrated in FIG. 1. With the post abutting the board, the housing is of greater rigidity.

Figure 4:
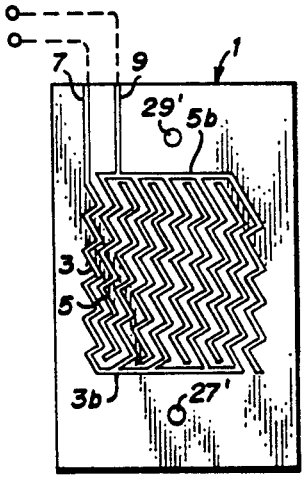
FIG. 4 illustrates the conductor portion of the sensor of FIG. 1 in top view.

The arrangement of the interdigitated conductors, 3 and 5, is better illustrated in FIG. 4, to which reference is made. In this figure circuit board 1 is illustrated to the same scale as the preceding two figures and presents the preferred arrangement of the conductors in top plan view. Conductor 3 is shown to contain seven zig-zag or serpentine portions, not separately labeled, which are joined together electrically in common by transversely extending conductor portion, 3B, shown horizontal in the figure. Each of the conductor portions are seen to extend relatively vertically, linearly, in a zig-zag or serpentine pattern, as variously characterized. The terminal lead, 7, to this conductor portion is taken by choice from a connection to one of such extending fingers. A like arrangement exists for the other conductors, 5, which are joined together by a horizontally extending conductor, 5B. In this instance, the terminal conductor, 9, is taken by choice from a connection to conductor 5B so that both terminal conductors may exit from the same side of the circuit board.

Circuit conductors 5 are shown to contain seven vertically extending zig-zag or serpentine shaped fingers which extend downwardly in the figure. The spaced fingers of circuit portion 5 are arranged interdigitally with the corresponding fingers of circuit portion 3. The end of the fingers of this portion extend to within a short distance above conductor 3B of the other portions, and, conversely, the fingers of the circuit portion 3B extend to a position just below conductor 5B of the second circuit portion. The spacing prevents any direct electrical contact between the two circuit portions, effectively isolating the two portions from direct electrical contact. Preferably the width and length of the conductive fingers in each set are identical and are the same as the corresponding dimensions of the other sets. Of course in alternative embodiments the width and length of the fingers may be varied and may be different from one another to suit particular operational requirements.

Figure 5:
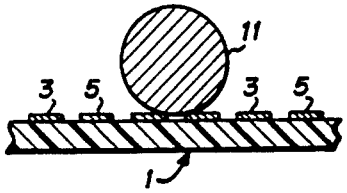
FIG. 5 illustrates to enlarged scale a section view of the ball element and underlying portion of the circuit board.

As shown to an enlarged scale in the partial section view of FIG. 5, ball 11 is shown at rest in contact with adjacent conductors of the two circuit portions. The diameter of ball 11 is greater than the interdigital spacing between the interdigitated fingers. The ball in this position, thus, serves as an electrical bridge to form an electrical contact bridging circuit portions 3 and 5, effectively closing an electrical circuit between the two conductor portions. As is apparent, as ball 11 moves relative to circuit board 1, in the section of the cavity in which the conductive fingers are essentially perpendicular to the chamber, the ball interrupts or breaks the contact between the two adjacent conductors, as shown in FIG. 5, rolls over one of the conductors thereby interrupting the circuit and current through the two portion's stops. As movement continues electrical contact between the two circuit portions is re-established by the ball as the ball moves relatively forwardly to the left in the figure to bridge the contact between the next two adjacent fingers. Alternatively, with slight vibration the ball may break contact with the conductors and then roll back to re-establish the direct electrical connection between the two circuit portions through the same two conductive fingers.

As depicted in FIG. 3, the preferred diameter of the ball is also less than the width of the washer like top wall that serves as the top end of the chamber. This permits the ball to travel radially to a limited extent toward and away from post 19, in between the post and conic shaped wall, 21. As may be appreciated, from the zig-zag pattern to the conductors illustrated in FIG. 4, movement radially in a straight line, as represents radial movement of the ball, also results in an interruption of the circuit. As the conductors are not straight, but zig-zagged, the ball's movement in a straight radial path causes the ball to move off of contact with adjacent conductors and interrupt the electrical circuit in the manner as before stated at last once during such radial travel.

In a specific example, the diameter of ball 11 is 0.125 inches, the width of the conductive fingers is 0.012 inches, and the interdigital spacing is 0.012 inches. The thickness of the conductive fingers is 0.002 inches.

The associated electrical circuit which supplies the voltages via terminals 7 and 9 is sensitive enough to detect the initial interruption in the closed electrical circuit formed by the two sets of conductors and the metal ball.

Figure 6:
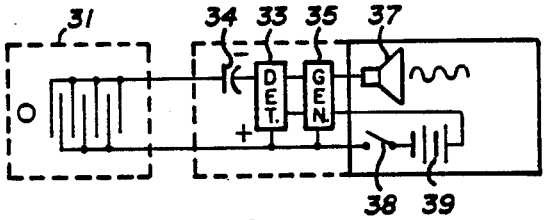
FIG. 6 illustrates an electrical schematic of the motion detector and associated audio circuits.

Referring now to FIG. 6, a complete motion detector and alarm combination is illustrated in schematic form. The circuit includes the motion sensor of the preceding figures symbolically illustrated, 31; an integrated circuit 33, which serves to detect any transition in electrical voltage resulting from the circuit interruption discussed; an alarm generator 35, symbolically illustrated, which, when actuated by circuit 33, causes an audio signal to input to the loud speaker, 37. A battery, 39, serves as a source of power. The entire assembly may be contained upon a single circuit board, which is the preferred arrangement. For use in a novelty item, alarm generator, 35, contains appropriate programming or suitable program in Read Only Memory as when electronically read out creates a chirping sound, when one desires to simulate a bird's chirping. It may also contain other sounds stored in digital form as an alternative, as a dog's barking, when desired to simulate the sounds produced by that animal. Such programming is entirely conventional and need not be described in detail.

Detector 33 contains appropriate time delay circuits. Once current interruption resulting from ball movement is detected the circuit provides an output to the audio generator, 35, for at least a precisely defined time interval. When multiple interruptions are detected, the circuit re-initiates that time interval so that an audio output is produced for a precise interval following the cessation of such circuit interruptions. Thus, when, for example, the item to which the motion sensor is attached is petted or shaken and then replaced in a stable position, the audio produced continues for a short while. Accordingly, while amusement is served the battery power is thereby conserved. The motion sensor can be used in other applications in which battery power conservation is not a limiting factor. In that instance, the alarm sound may be permitted to run continuously until the circuit is manually reset by the user.

Figure 7:
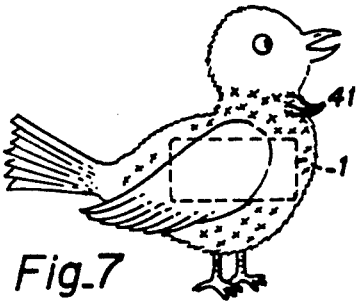
FIG. 7 illustrates the motion sensor installed in a figurine.

For completeness, and as required for basis to the claims, FIG. 7 illustrates a novelty item, suitably a doll, which simulates a bird in appearance. The motion detector of FIG. 6 is represented as having been inserted in the body cavity within the doll. Where the doll is formed of molded plastic material the circuit will be mounted to appropriately formed plastic mounting elements, not specifically illustrated. However, if the doll is formed as a stuffed animal, such as commonly referred to as a plush animal, the circuit will be installed in stuffing material contained within the body of the doll represented by the lines 41. Appropriate access through a panel in the doll allows access to batteries so that the user may replace that element. Preferably this is accomplished with a battery compartment as may be covered by a velcro fastened flap.

It is believed that the foregoing description of the preferred embodiment of the invention is sufficient in detail to enable one skilled in the art to make and use the invention.

Figure 8:
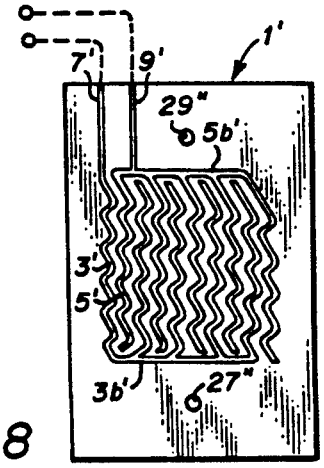
FIG. 8 illustrates an alternative form of the element of FIG. 4.

An alternative geometry for the conductors of the foregoing embodiment is presented in FIG. 8. For convenience, the elements in this figure are identified by the same numbers used to identify the corresponding elements of FIG. 4 with the addition of a prime symbol. As shown, conductors 3' and 5' in FIG. 8 turn one way and then the other with corners that are more rounded than the sharp corners presented in the structure of FIG. 4. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus, the invention is to be broadly construed within the full scope of the appended claims.

What is claimed is:

1. A motion sensor comprising:

a sphere of predetermined diameter having an outer surface of electrically conductive material;

a board of electrically insulative material defining a board surface, said board including electrical conductor means supported on said board surface;

said electrical conductor means including: a first series and a second series of electrical conductors, each said series containing a plurality of generally elongated extending conductors with said plurality of conductors being physically spaced apart from one another to define extending fingers and being connected electrically in common, whereby each of said first and second series thereby defines first and second electrical circuit portions;

said conductors of said first series and said second series being arranged interdigitally on said board surface with interdigital spacing between adjacent conductors of said first and second series to thereby preclude direct electrical contact between said adjacent conductors;

a housing member for confining said sphere and covering said first and second series of conductors, said housing member comprising a one piece molded assembly of electrically non-conductive material;

said housing member including:

a top;

a bottom;

a central cylindrical post in said top, said post being of a predetermined height downwardly extending from said top and containing an end;

a inner side wall spaced from and surrounding said post, said inner side wall comprising a right conic section with the axis of said conic section being essentially co-axial with the axis of said post and defining a taper inwardly directed from said bottom toward said post;

said top including an annular top inner wall of predetermined width to close an end of the space between said post and said inner side wall;

said housing member being mounted to said board in a position overlying said first and second series of electrical conductors with said end of said post being in abutment with a portion of said first and second series of between said board and said housing with said closed annular cavity providing a race for said sphere;

said closed annular cavity being in confronting relationship with said first and second series of conductors and said first and second series of conductors extending transverse of said annular cavity; and said sphere being located within said closed annular cavity for rolling movement, whereby movement of said sphere in said race causes the ball to bridge or unbridge contact between adjacent conductors of said first and second series to close and open, respectively, a current conducting path between said first and second series.

2. The invention as claimed in claim 1, wherein said predetermined diameter of said sphere comprises a diameter no greater than said width of said top inner wall and greater in diameter than the space between adjacent ones of said interdigitated conductors to permit said sphere to roll in the formed race and to bridge the interdigital space between at least one conductor of each of said first and second series to close an electrical circuit path between said first and second electrical circuit portions; and wherein said elongate conductors in each said first and second series is of a length at least as great as the outer diameter of said top inner wall.

3. The invention as defined in claim 1, wherein each of said conductors of said first and second series comprises: a linearly extending zigzag shape.

4. The invention as defined in claim 3 wherein said predetermined diameter of said sphere comprises a diameter no greater than said width of said top inner wall and greater in diameter than the space between adjacent ones of said interdigitated conductors to permit said sphere to roll in the formed race and to bridge the interdigital space between at least one conductor of each of said first and second series to close an electrical circuit path between said first and second electrical circuit portions; and wherein said elongate conductors in each said first and second series is of a length at least as great as the outer diameter of said top inner wall;

wherein said housing member comprises further:

a rectangular shaped flange portion having a generally planar outer surface with said flange portion being essentially co-planar with said end of said post; and wherein the length of said conductors in each said series is less than the greatest dimension of said flange portion; and further comprising:

rivet means for fastening said housing member to said board;

first terminal lead means connected to said first series and second terminal lead means connected to said second series, each of said lead means extending from a position underlying said flange portion to a position on said board external of said housing member to permit connection to an electrical circuit external of said housing member.

5. The invention as defined in claim 13, wherein said end of said post comprises a flat surface.

6. The invention as defined in claim 1, wherein each of said conductors of said first and second series comprises: a linearly extending serpentine shape.

7. The invention as defined in claim 1, wherein said housing member comprises further:

a rectangular shaped flange portion having a generally planar outer surface with said flange portion being essentially co-planar with said end of said post; and wherein the length of said conductors in each said series is less than the greatest dimension of said flange portion.

8. The invention as defined in claim 1, further comprising: rivet means for fastening said housing member to said board.

9. The invention as defined in claim 7, further comprising: first terminal lead means connected to said first series and second terminal lead means connected to said second series, each of said lead means extending from a position underlying said flange portion to a position on said board external of said housing member to permit connection to an electrical circuit external of said housing member.

10. The invention as defined in claim 1 wherein said sphere comprises the material steel.

11. The invention as defined in claim 1 further comprising:

electrical circuit means connected to said first and second series for providing electrical current therethrough; and means responsive to a change in current flow through said series of conductors for producing a signal.

12. The invention as defined in claim 11 wherein said signal comprises an audible signal.

13. The invention as defined in claim 11 wherein said means responsive to a change in current flow through said series of conductors for producing a signal further includes:

means for producing a signal of at least a predetermined duration in response to each detected change in current flow through said series of conductors.

14. The invention as defined in claim 11 wherein said signal comprises an audible sound simulating a bird's chirping.

15. A motion sensor comprising:

a ball having an electrically conductive outer surface;

a printed circuit board including:

a first series and a second series of electrical conductors, each of said first and second series containing a plurality of generally linearly extending zigzag shaped conductors spaced apart from one another to define extending fingers with said extending fingers being connected electrically in common, whereby each of said first and second series thereby defines first and second electrical circuit portions;

said conductors of said first series and said second series being arranged interdigitally on said circuit board and in spaced relationship to preclude direct electrical contact therebetween;

a housing member for covering said first and second series of conductors and defining with said printed circuit board a race for said ball, said housing member comprising a one piece molded assembly of electrically insulative material and forming an annular cavity;

said annular cavity including:

a central post defining a first cavity wall;

an inner side wall comprising a right conic section oriented surround and oriented coaxial of said post;

said housing member being mounted to said board in a position overlying said first and second series of electrical conductors with said end of said post being in abutment with a portion of said first and second series of electrical conductors to define a closed annular cavity formed between said board and said housing with said closed annular cavity providing a race for said sphere;

said closed annular cavity being in confronting relationship with said first and second series of conductors and with said first and second series of conductors extending transverse of said annular cavity;

wherein said ball may roll in said annular cavity peripheral of and radially therewithin to bridge the interdigital space between at least one conductor of each of said first and second series for closing an electrical circuit path therebetween and wherein movement of said sphere in said cavity causes the ball to bridge or unbridge contact between adjacent conductors of said first and second series to close and open, respectively, a current conducting path between said first and second series of conductors.

16. A motion sensor and alarm combination, comprising:

a sphere having at least an outer surface electrically conductive material;

a board of electrically insulative material defining at least one planar surface, said board including electrical conductor means supported on said planar surface;

said electrical conductor means, including: a first series and a second series of electrical conductors;

a plurality of generally elongate extending conductors with said plurality of conductors being physically spaced apart from one another to define extending fingers with said fingers extending in a first direction; and bridging conductor means connecting said fingers electrically in common;

said second series of electrical conductors including:

a plurality of generally elongate extending conductors with said plurality of conductors being physically spaced apart from one another to define extending fingers with said fingers extending in a second direction, opposite to said first direction; and bridging conductor means connecting said fingers electrically in common;

said fingers of said first series being arranged interdigitally with and spaced from said fingers and bridging conductor means of said second series and said fingers of said second series being spaced from said bridging conductor means of said first series to prevent direct physical contact between said first and second series of electrical conductors;

a housing member for confining said sphere and covering said first and second series of conductors, and comprising a one piece molded assembly of electrically non-conductive material; said housing member including an annular cavity with said annular cavity being open along one side for receiving said sphere for movement within said annular cavity;

said housing member further including:

a top;

a bottom;

a post;

said post being located in and downwardly extending from said top; said post having an outer cylindrical surface and an end;

a inner annular side wall;

said inner annular side wall being spaced from and peripherally surrounding said post; said inner annular side wall comprising a surface of he geometry of a right conic section with the axis of said conic section being essentially co-axial with the axis of said post and with said side wall defining a taper inwardly directed from said bottom toward said top;

said top including an annular top washer-shaped inner wall of predetermined width to close an end of the space between said post and said inner side wall for defining said annular cavity in said housing;

said housing member being mounted to said board in a position overlying said first and second series of electrical conductors with said end of said post being in abutment with at least a portion of said first and second series of electrical conductors and with said bottom of said housing member being in abutment with at least said board to define a closed annular cavity between said board and said housing member, whereby said closed annular cavity provides a race for said sphere;

said first and second series of conductors extending transverse of said closed annular cavity;

said predetermined diameter of said sphere being no greater than said width of said top inner wall and being greater in diameter than the space between adjacent ones of said interdigitated conductors to permit said sphere to move in said formed race at least peripherally and radially and, during movement, to alternately bridge and un-bridge the interdigital space between at least one conductor of each of said first and second series to alternately close and open, respectively, an electrical current conducting path between said first and second series of conductors; and wherein the length of said conductors in each said first and second series is at least as great as the outer diameter of said top inner wall;

electronic processing means, said electronic processing means including;

means for connecting said first and second series of conductors into a series electrical path and applying a source of DC current to said series electrical path, whereby electrical current may flow in said series electrical path responsive to said series electrical path being closed, with a current surge upon closing said path, and electrical current is inhibited from flowing in said path responsive to said series electrical path being open, with a current surge upon opening said path;

detector means for producing an output for a predetermined time interval responsive to detection of each current surge in said series electrical path, said current surge being caused by either an interruption in electrical current flow in said series electrical path or by commencement of electrical current flow in said series electrical path; and sound generating means, including speaker means, for generating an audible signal responsive said detector means output.

17. A motion sensor comprising:

a sphere of predetermined diameter having an outer surface of electrically conductive material;

a board of electrically insulative material defining a board surface, said board including electrical conductor means supported on said board surface;

said electrical conductor means including: a first series and a second series of electrical conductors, each said series containing a plurality of generally elongated extending conductors with said plurality of conductors being physically spaced apart from one another to define extending fingers and being connected electrically in common, whereby each of said first and second series thereby defines first and second electrical circuit portions;

said conductors of said first series and said second series being arranged interdigitally on said board surface with interdigital spacing between adjacent conductors of said first and second series to thereby preclude direct electrical contact between said adjacent conductors;

a housing member for confining said sphere and covering said first and second series of conductors, said housing member comprising a one piece molded assembly of electrically non-conductive material;

said housing member including:

a top;

a bottom;

a central cylindrical post in said top, said post being of a predetermined height downwardly extending from said top and containing an end;

a inner side wall spaced from and surrounding said post, said inner side wall comprising a right conic section with the axis of said conic section being essentially co-axial with the axis of said post and defining a taper inwardly directed from said bottom toward said post;

said top including an annular top inner wall of predetermined width to close an end of the space between said post and said inner side wall;

said housing member being mounted to said board in a position overlying said first and second series of electrical conductors with said end of said post being in abutment with said electrical conductor means to define a closed annular cavity formed between said board and said housing with said closed annular cavity providing a race for said sphere;

said closed annular cavity being in confronting relationship with said first and second series of conductors and said first and second series of conductors extending transverse of said annular cavity; and said sphere being located within said closed annular cavity for rolling movement, whereby movement of said sphere in said race causes the ball to bridge or unbridge contact between adjacent conductors of said first and second series to close and open, respectively, a current conducting path between said first and second series.

* * * * *